US007029111B2

(12) United States Patent
Speich

(10) Patent No.: US 7,029,111 B2
(45) Date of Patent: Apr. 18, 2006

(54) UNIT FOR THE CONTINUOUS PRODUCTION OF PRINTED TEXTILE STRIPS, IN PARTICULAR PRINTED LABEL STRIPS

(75) Inventor: Francisco Speich, Gipf-Oberfrick (CH)

(73) Assignee: Textilma AG, (CH)

( * ) Notice: Subject to any disclaimer, the term of this patent is extended or adjusted under 35 U.S.C. 154(b) by 45 days.

(21) Appl. No.: 10/363,006

(22) PCT Filed: Jul. 19, 2001

(86) PCT No.: PCT/CH01/00450

§ 371 (c)(1),
(2), (4) Date: Feb. 26, 2003

(87) PCT Pub. No.: WO02/18142

PCT Pub. Date: Mar. 7, 2002

(65) Prior Publication Data

US 2005/0012799 A1 Jan. 20, 2005

(30) Foreign Application Priority Data

Aug. 31, 2000 (CH) ..... 1699/00

(51) Int. Cl.
*B41J 2/01* (2006.01)

(52) U.S. Cl. ..... 347/104; 400/621; 400/621.1

(58) Field of Classification Search ..... 347/101, 347/104; 428/42; 400/621, 621.1
See application file for complete search history.

(56) References Cited

U.S. PATENT DOCUMENTS

| | | | | |
|---|---|---|---|---|
| 3,892,901 | A | 7/1975 | Smith | |
| 4,371,582 | A * | 2/1983 | Sugiyama et al. | 428/32.23 |
| 5,079,980 | A | 1/1992 | Oakes et al. | |
| 5,546,178 | A | 8/1996 | Manzer et al. | |

FOREIGN PATENT DOCUMENTS

DE 26 24 055 A 2/1978

(Continued)

*Primary Examiner*—Stephen Meier
*Assistant Examiner*—Ly T. Tran
(74) *Attorney, Agent, or Firm*—George Pappas

(57) ABSTRACT

The invention relates to a unit for the continuous production of printed textile strips, in particular, printed label strips, comprising a supply station (2) for a textile web (4), a printing station (8) for printing the textile web and a fixing station (20) for the print. According to the invention, the capacity may be improved whereby the unit is embodied such that said unit can process a textile web (4), the width (B1) of which corresponds to a multiple of the width (B2) of the printed textile strip (18). The printing station (8) is embodied to print one printing line per textile strip (18). A longitudinal cutting station (22), for cutting the textile strip (4) longitudinally between the printed lines is arranged after the printing station (8).

10 Claims, 2 Drawing Sheets

FOREIGN PATENT DOCUMENTS

| | | | | |
|---|---|---|---|---|
| DE | 197 27 767 | A1 | | 1/1999 |
| DE | 199 30 858 | A1 | | 2/2000 |
| EP | 0 080 448 | A2 | | 6/1983 |
| EP | 0 427 933 | A1 | | 5/1991 |
| EP | 0 624 682 | A1 | | 11/1994 |
| EP | 0 659 569 | A1 | | 6/1995 |
| EP | 0 694 594 | A2 | | 1/1996 |
| EP | 0 835 761 | A2 | | 4/1998 |
| GB | 2271081 | A | * | 6/1994 |
| JP | 56132528 | A | * | 10/1981 |
| JP | 08 311782 | A | | 11/1996 |
| WO | WO 96 20081 | A | | 7/1996 |
| WO | WO 98 03724 | A | | 1/1998 |
| WO | WO 98 54399 | A | | 12/1998 |
| WO | WO 00 09572 | A | | 2/2000 |

* cited by examiner

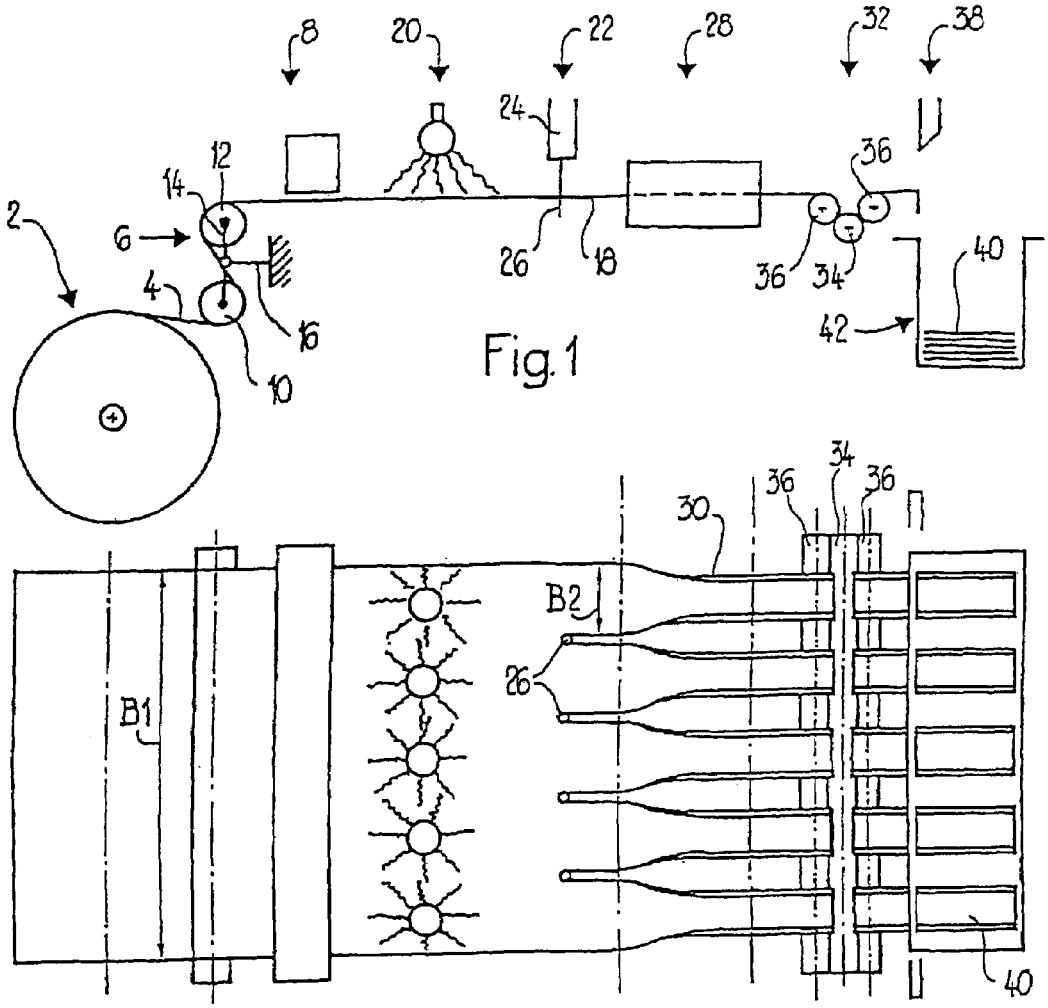
Fig.1
Fig.2
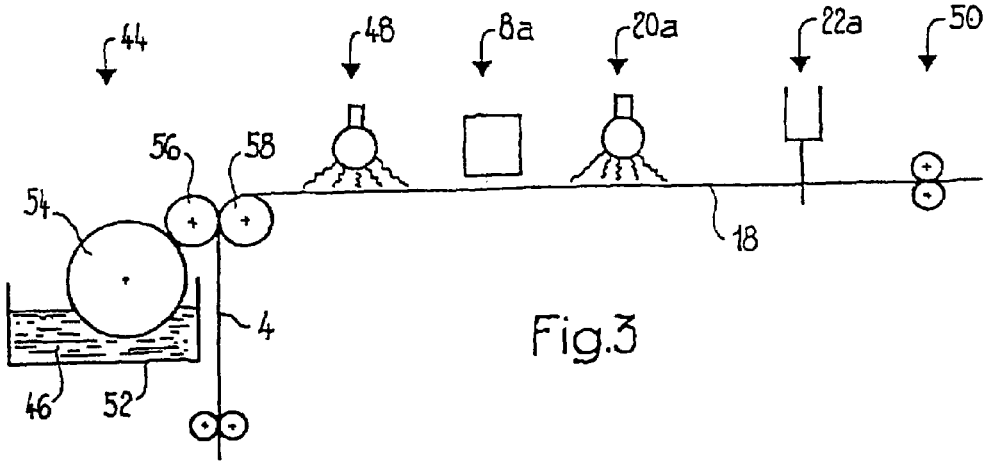
Fig.3

UNIT FOR THE CONTINUOUS PRODUCTION OF PRINTED TEXTILE STRIPS, IN PARTICULAR PRINTED LABEL STRIPS

TECHNICAL FIELD

The invention relates to a unit for the continuous production of printed label strips.

PRIOR ART

Units of the type cited at the beginning are known, for example from U.S. Pat. No. 5,079,980. In the case of this unit, there is a coil of strip as a supply mechanism, which prints an individual strip at printing stations and leads them to a stacking apparatus, in which the printed label strips are cut off and stacked. The disadvantage is that only a single textile strip can be printed and stacked in the complicated apparatus, which limits the efficiency of the unit.

SUMMARY OF THE INVENTION

It is an object of the invention to improve a unit of the type cited at the beginning so that a higher performance is possible.

Since the supply station provides a textile web whose width corresponds to a multiple of the width of the printed textile strip, the individual assemblies of the stations of the unit can be utilized more economically, so that the unit permits a performance which corresponds to a multiple of the performance of conventional units. The performance is virtually multiplied by the number of textile strips produced simultaneously.

For the configuration of the printing station, there result various possibilities, depending on which printing process is used and whether printing is to be carried out in one or many colors. In this case, consideration is given only to printing appliances which permit electronic data processing and operate at an appropriately high speed. Particularly preferred is an ink-jet printer, which can be configured with one or more colors and in which the individual characters are assembled in the manner of a mosaic from extremely fine ink-jet droplets. This also allows, in particular, a relatively small print head which can be configured to move to and fro transversely over the textile web. Such an ink-jet printer can be designed to process printing inks based on water. More advantageous is a configuration for processing printing inks that can be polymerized by electromagnetic steels.

Also advantageous is a configuration of the printing station as a laser printer, in which a laser beam whose direction is controlled by a program writes the characters onto an electrostatically precharged photo semiconductor film. The charge image produced is transferred to the textile web with the aid of toner particles by the printing drum covered with the film. In the simplest case, the printing station can print in one color, but a configuration is also advantageous, according to which the printing station is designed as a multicolor printer and preferably has a plurality of print heads arranged one after another for different colors.

It may be expedient to connect a conditioning station before the printing station, in order to set the temperature and/or the humidity of the textile web to a predetermined value that is suitable for the printing station. This is advantageous in particular for printers which operate on the electrostatic process.

For other printing processes, in particular for a printing station with an ink-jet printer, a treatment station for the application of an agent that improves the print, and also a following fixing station, are connected before the printing station. By means of the treatment agent, a uniform surface of the textile web can be achieved and/or the flow properties of the textile web can be at least reduced or even eliminated.

In order to fix or to dry the print on the textile web, a fixing station is connected after the printing station. The design of the fixing station depends on the printing principle used. Here, care should be taken, in particular, that the fixing is carried out as quickly as possible and the print is as resistant as possible. For polymerizable printing inks, a fixing station for emitting polmerizing electromagnetic steels is particularly suitable, preferably an UV emitter. For laser printers operating with toner, an IR fixing station is preferred, which supplies the necessary heat to melt the toner particles onto the textile web. In the latter case, an additional press station is advantageous, which presses the print into the textile web and therefore improves the connection.

In addition, it is an advantage that the unit has a strip fixing station for the printed textile web, in order to free the textile web of tension and to smooth it.

Particularly advantageous is a configuration of the unit, according to which the printing station has a coating station connected after it, in order to provide the printed textile web with a protective layer. Such a protective layer protects the print on the textile web against mechanical and chemical stress.

In order to improve the quality of the printed textile strips produced, the unit can be provided with a folding station in order to fold the edge regions of the printed textile strips toward each other and therefore to turn an ugly or rough cut edge inward away from the marginal region. The fold can be fixed permanently by a fixing station connected after the folding station.

The printed textile strips can either be rolled up or deposited in an unstructured position in a container. More advantageous, however, is a configuration of the unit according to which there is a crosscutting station in order to subdivide the printed textile strip into sections. This crosscutting station can advantageously have a stacking apparatus arranged after it, in order to collect the textile strip sections in an ordered form.

A particularly economic unit results if, for the pre-treatment and/or for the printing and/or for the post-treatment polymerizable agents are used which permit application and quick fixing, which is of great significance for mass production, such as is the case in the production of labels. For the purpose of fixing by polymerization, a very wide range of types of electromagnetic rays can be used. For example, infrared rays can be used. Electromagnetic rays in the ionizing range, in particular in the X-ray or gamma-ray range are suitable. Quite particular preference is given to UV rays, which allow rapid fixing at beneficial costs.

BRIEF DESCRIPTION OF THE DRAWINGS

Exemplary embodiments of the invention will be described in more detail below using schematic drawings, in which:

FIG. 1 shows a first unit for the continuous production of printed textile strips, in particular printed label strips, in side view;

FIG. 2 shows the unit of FIG. 1 in outline;

FIG. 3 shows a second unit having a treatment station connected before the printing station, in side view.

WAYS OF IMPLEMENTING THE INVENTION

Figure 4:
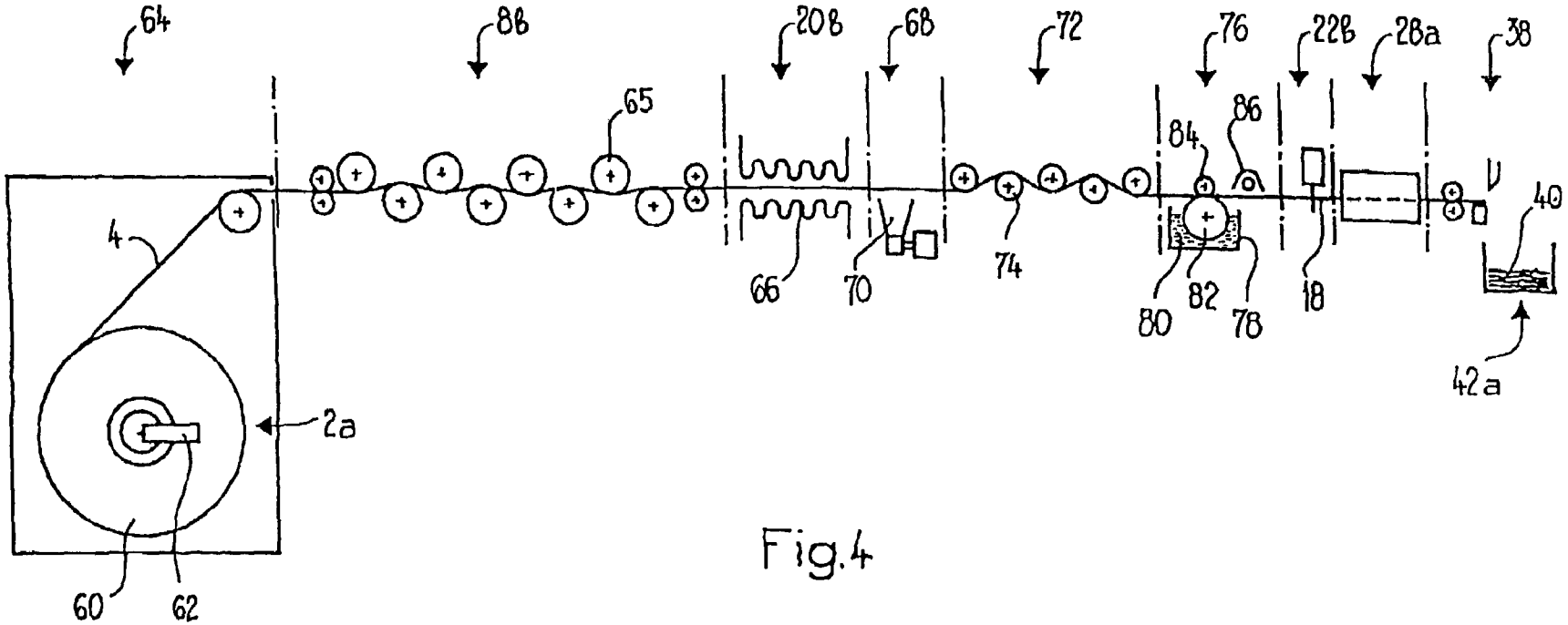
FIG. 4 shows a third unit having a conditioner station connected before the printing station and various post-treatment stations connected after the printing station, in side view.

FIGS. 1 and 2 show a first unit for the continuous production of printed textile strips, in particular printed label strips. The unit contains a supply station 2, on which a textile web 4 is wound up whose width B1 is a multiple, here five times, of the width B2 of the textile strips to be produced. The textile web 4 is supplied to a printing station 8 over an apparatus to equalize the run 6. The apparatus to equalize the run 6 contains two deflection rolls 10, 12, which are mounted on a rocker 14 which is pivotably connected to the machine frame 16.

The printing station 8 can be configured in a very wide range of ways and preferably has an ink-jet printer which prints on the textile web with a polymerizable color. The printer provides the textile web with a print, not specifically illustrated, which is in each case specific to the textile strip 18 to be produced. Connected after the printing station 8 is a fixing station 20, which fixes the print by polymerization by means of electromagnetic steels.

At a following longitudinal cutting station 22, the textile web 4 is subdivided into textile strips 18. The longitudinal cutting station contains a cutting heads 24 corresponding to the number of desired cuts and, for example, provided with a thermal cutting wire 26. The longitudinal cutting station 22 is followed by a folding station 28, at which the edge regions 30 of the textile strips 18 are folded toward each other. In a strip fixing station 32 which follows, the folded textile strips are fixed in their form. For this purpose, the fixing station has a heating roll 34 and two press rolls 36, which press the folded textile strips against the heating roll 34. In a subsequent crosscutting station 38, the textile strips folded in this way are in turn cut up into textile strip sections 40, which are stacked in a stacking apparatus 42.

In order to control the unit, use is made of an electronic control apparatus, not specifically illustrated, which in particular controls the printing station and also co-ordinates the other stations of the unit with one another.

FIG. 3 shows a further unit for the continuous production of printed textile strips, in particular printed label strips, which has a supply station, not specifically illustrated, from which a broad textile web 4 is fed firstly to a treatment station 44, in which the textile web is provided with an agent 46. The agent is used to balance out the textile structure and/or reduce the flow property of the fibrous material of the textile web, in order to improve the print at the printing station. The agent applied is fixed in the following fixing station 48, which is preferably designed as a UV emitter. The textile web 4, as in the first example, then passes through a printing station 8*a*, a fixing station 20*a* and a longitudinal cutting station 22*a*, in which the textile web 4, as in the first example, is cut up into textile strips 18, which are pulled off by a pull-off apparatus 50. As in the first example, the textile strips 18 can be cut up into textile strip sections or wound onto a roll or deposited in an unstructured position in a container.

In the present example, the treatment station 44 is designed as an application apparatus and contains a trough 52 for the agent 46, into which there dips a dip roll 54 in order to pick up the agent 46 and discharge it to a transfer roll 56, which is connected to the textile web 4, which is led over a backing roll 58. The amount of agent 46 to be applied can be set, in a manner not specifically illustrated, by setting the immersion depth of the dip roll 54 and the play or the pressure force between the various rolls. Instead of the application apparatus, the agent can also be applied by means of a dip bath, not specifically illustrated, through which the textile web is led, or by means of a spraying apparatus, which is likewise not specifically illustrated.

FIG. 4 shows a further unit for the continuous production of printed textile strips, in particular printed label strips. The unit contains a supply station 2*a*, in which there is arranged a supply roll 60 of the textile web 4 to be printed. A drive motor 62 is used for the controlled drive of the supply roll 60. The supply station 2*a* is combined with a conditioning station 64, in order to impart the temperature and/or humidity required for the respective printing process to the textile web 4. The conditioning station 64 is followed by a printing station 8*b* which, in the present example, operates on the electrostatic printing process and has corresponding transfer rolls 65. The printing station is followed by a fixing station 20*b* in order to fix the print. In the present example, the fixing station operates with a heat source 66, for example, an IR emitter, in order to fuse the terminal onto the textile web 4. In a subsequent cooling station 68, the textile web with the print is cooled, for example by means of a blower 70. This is followed by a strip fixing station 72, in order to press the print into the textile web. For this purpose there are various heated rolls 74, over which the textile web is pulled with the printed side in a meandering shape. The rolls can be adjusted relative to one another, so that a pressure is exerted on the pattern owing to the tension produced in the textile web. The rolls 74 can be provided with a controlled drive apparatus, in order to co-ordinate the circumferential speed of the rolls with one another and keep them synchronized.

A strip fixing station 72 is further followed by a coating station 76, in order to provide the printed surface of the textile web 4 with a coating protecting the print. The coating station contains a trough 78 with the coating agent 80, for example a transparent resin solution, into which a transfer roll 82 dips. The textile web 4 bears on the transfer roll 82 and is pressed against the latter by means of a coating roll 84 in order to distribute the coating agent on the textile web in a metered quantity. The coating station 76 contains a fixing device 86, for example a UV emitter, in order to fix the coating agent 80 on the textile web 4.

In a way analogous to the exemplary embodiment of FIGS. 1 and 2, the wide textile web 4 is cut up into individual textile strips 18 in a following longitudinal cutting station 22*b*. In a following folding station 28*a*, the edges of the textile strips 18 are folded toward each other. In a subsequent crosscutting station 38*a*, the textile strips 18 are cut up into textile strip sections 40 and stacked in a stacking apparatus 42*a*.

LIST OF REFERENCE SYMBOLS

B1 Width of the textile web
B2 Width of the textile strips
2 Supply station
2*a* Supply station
4 Textile web
6 Apparatus to equalize the run
8 Printing station
8*a* Printing station
8*b* Printing station
10 Deflection roll

12 Deflection roll
14 Rocker
16 Machine frame
18 Textile strip
20 Fixing station
20*a* Fixing station
20*b* Fixing station
22 Longitudinal cutting station
22*a* Longitudinal cutting station
22*b* Longitudinal cutting station
24 Cutting head
26 Cutting wire
28 Folding station
28*a* Folding station
30 Edge region
32 Strip fixing station
34 Heating roll
36 Press roll
38 Crosscutting station
38*a* Crosscutting station
40 Textile strip section
42 Stacking apparatus
42*a* Stacking apparatus
44 Treatment station
46 Agent
48 Fixing station
50 Pull-off apparatus
52 Trough
54 Dip roll
56 Transfer roll
58 Backing roll
60 Supply roll
62 Drive motor
64 Conditioning station
65 Transfer roll
66 Heat source
68 Cooling station
70 Blower
72 Strip fixing station
74 Heated rolls
76 Coating station
78 Trough
80 Coating agent
82 Transfer roll
84 Coating roll
86 Fixing station

The invention claimed is:

1. A unit for the continuous production of printed textile strips, in particular printed label strips, containing a supply station, a printing station and a fixing station for the print, characterized in that it is designed to process a textile web whose width corresponds to a multiple of the width of the printed textile strip, in that, furthermore, the printing station is designed to print a printed line per textile strip, and in that a longitudinal cutting station for cutting the textile strip longitudinally between the printed lines is arranged after the printing station and further characterized in that it has a folding station in order to fold the edge regions of the printed textile strips toward each other, a strip fixing station preferably being connected after the folding station.

2. The unit as claimed in claim 1, characterized in that at least one of the fixing stations is designed to carry out polymerization by means of electromagnetic rays.

3. The unit as claimed in claim 2, characterized in that at least one of the fixing stations has an emitter of electromagnetic radiation in the infrared range.

4. The unit as claimed in claim 2, characterized in that at least one of the fixing stations has an emitter of electromagnetic radiation in the ultraviolet range.

5. The unit as claimed in claim 2, characterized in that at least one of the fixing stations has an emitter of electromagnetic radiation in the ionizing range, in particular in the X-ray or gamma-ray range.

6. A unit for the continuous production of printed textile strips, in particular printed label strips, containing a supply station, a printing station and a fixing station for the print, characterized in that it is designed to process a textile web whose width corresponds to a multiple of the width of the printed textile strip, in that, furthermore, the printing station is designed to print a printed line per textile strip, and in that a longitudinal cutting station for cutting the textile strip longitudinally between the printed lines is arranged after the printing station and further characterized in that it has a crosscutting station in order to subdivide the printed textile strips into textile strip sections, a stacking apparatus preferably being arranged after the crosscutting station.

7. The unit as claimed in claim 6, characterized in that at least one of the fixing stations is designed to carry out polymerization by means of electromagnetic rays.

8. The unit as claimed in claim 7, characterized in that at least one of the fixing stations has an emitter of electromagnetic radiation in the infrared range.

9. The unit as claimed in claim 7, characterized in that at least one of the fixing stations has an emitter of electromagnetic radiation in the ultraviolet range.

10. The unit as claimed in claim 7, characterized in that at least one of the fixing stations has an emitter of electromagnetic radiation in the ionizing range, in particular in the X-ray or gamma-ray range.

* * * * *